US011112120B2

(12) United States Patent
Flaherty et al.

(10) Patent No.: US 11,112,120 B2
(45) Date of Patent: Sep. 7, 2021

(54) ARTIFICIAL LOG ASSEMBLY

(71) Applicant: Warming Trends, LLC, Englewood, CO (US)

(72) Inventors: Voni D. Flaherty, Highlands Ranch, CO (US); Timothy S. Flaherty, Highlands Ranch, CO (US); Kevin F. O'Connor, Parker, CO (US); Timothy Allons, Jr., Highlands Ranch, CO (US); Colin J. Gray, Denver, CO (US)

(73) Assignee: Warming Trends, LLC, Englewood, CO (US)

( * ) Notice: Subject to any disclaimer, the term of this patent is extended or adjusted under 35 U.S.C. 154(b) by 50 days.

(21) Appl. No.: 16/719,446

(22) Filed: Dec. 18, 2019

(65) Prior Publication Data

US 2021/0190321 A1 Jun. 24, 2021

(51) Int. Cl.
*F24B 1/18* (2006.01)
*F24H 1/44* (2006.01)

(52) U.S. Cl.
CPC ..... *F24B 1/1808* (2013.01); *F24H 1/44* (2013.01)

(58) Field of Classification Search
CPC ..... F24B 1/1808; F24H 1/44
See application file for complete search history.

(56) References Cited

U.S. PATENT DOCUMENTS 948,561 A 2/1910 Hansen
1,239,346 A 9/1917 Brown
1,286,108 A 11/1918 Richards
2,516,282 A * 7/1950 Wilton ..... C21D 1/667 239/273
2,644,515 A * 7/1953 Lampert ..... F23D 14/10 239/432
3,187,740 A * 6/1965 Jones ..... F23C 3/002 126/91 A
3,334,820 A * 8/1967 Flynn ..... F23D 14/10 239/556
3,688,760 A * 9/1972 Rudin ..... F23C 3/002 126/91 A
4,061,133 A 12/1977 Swain
4,418,456 A * 12/1983 Riehl ..... F23D 14/10 239/566
4,582,478 A 4/1986 Hilker
(Continued)

FOREIGN PATENT DOCUMENTS

GB 2182431 A 5/1987

OTHER PUBLICATIONS

Extended European Search Report for Application No. EP20154333.7 dated Sep. 2, 2020.

*Primary Examiner* — David J Laux
*Assistant Examiner* — Nikhil P Mashruwala
(74) *Attorney, Agent, or Firm* — Bejin Bieneman PLC

(57) ABSTRACT

An artificial log assembly includes an artificial log having an outer wall that is substantially cylindrical and elongated along an axis. The artificial log has a cavity inside the outer wall. The artificial log assembly includes a fuel supply in the cavity. The fuel supply has a plurality of fuel outlets closer to the axis than to the outer wall. The fuel outlets are spaced from each other along the axis. Slits extend through the outer wall to the cavity. At least some of the slits are spaced from each other along the axis and are spaced from each other circumferentially about the axis.

20 Claims, 4 Drawing Sheets

(56) References Cited

U.S. PATENT DOCUMENTS

| | | | | | |
|---|---|---|---|---|---|
| 4,875,464 | A | | 10/1989 | Shimek et al. | |
| 4,890,601 | A | * | 1/1990 | Potter | F23D 14/04 126/512 |
| 4,971,031 | A | * | 11/1990 | Richardson | F24C 3/006 126/512 |
| 4,976,253 | A | * | 12/1990 | Beal | F24C 3/006 126/512 |
| 5,000,162 | A | | 3/1991 | Shimek et al. | |
| 5,069,200 | A | | 12/1991 | Thow et al. | |
| 5,081,981 | A | | 1/1992 | Beal | |
| 5,655,513 | A | | 8/1997 | Whitfield | |
| 5,901,697 | A | | 5/1999 | Oliver, Jr. et al. | |
| 6,048,195 | A | | 4/2000 | Shimek et al. | |
| 6,070,559 | A | * | 6/2000 | Schlesch | F22B 7/00 122/140.1 |
| 6,269,809 | B1 | | 8/2001 | Fleming | |
| 6,354,831 | B1 | | 3/2002 | Wilk, Jr. et al. | |
| 6,428,313 | B1 | * | 8/2002 | Rodgers | F23D 14/10 126/39 R |
| 6,602,068 | B2 | | 8/2003 | Atemboski et al. | |
| 6,916,174 | B2 | * | 7/2005 | O'Donnell | F23D 14/105 239/432 |
| 8,033,822 | B2 | | 10/2011 | Junkins | |
| 8,033,833 | B1 | | 10/2011 | Lai | |
| 9,625,147 | B2 | * | 4/2017 | Kato | F23C 3/002 |
| 2004/0058288 | A1 | | 3/2004 | Lyons et al. | |
| 2004/0089289 | A1 | | 5/2004 | Tingley | |

* cited by examiner

ARTIFICIAL LOG ASSEMBLY

BACKGROUND

Artificial log assemblies can be used as alternatives to wood-burning fires. Artificial log assemblies are formed of non-flammable materials and a fuel, e.g., natural gas or liquid propane, is ignited to simulate burning wood.

Artificial log assemblies include an outer shell that attempts to simulate the appearance of a wooden log. Fuel is supplied to the outer shell such that, when ignited, the fuel burns to appear as though the artificial log is on fire. There remains an opportunity to improve the effectiveness of artificial log assemblies.

DETAILED DESCRIPTION

Figure 1:
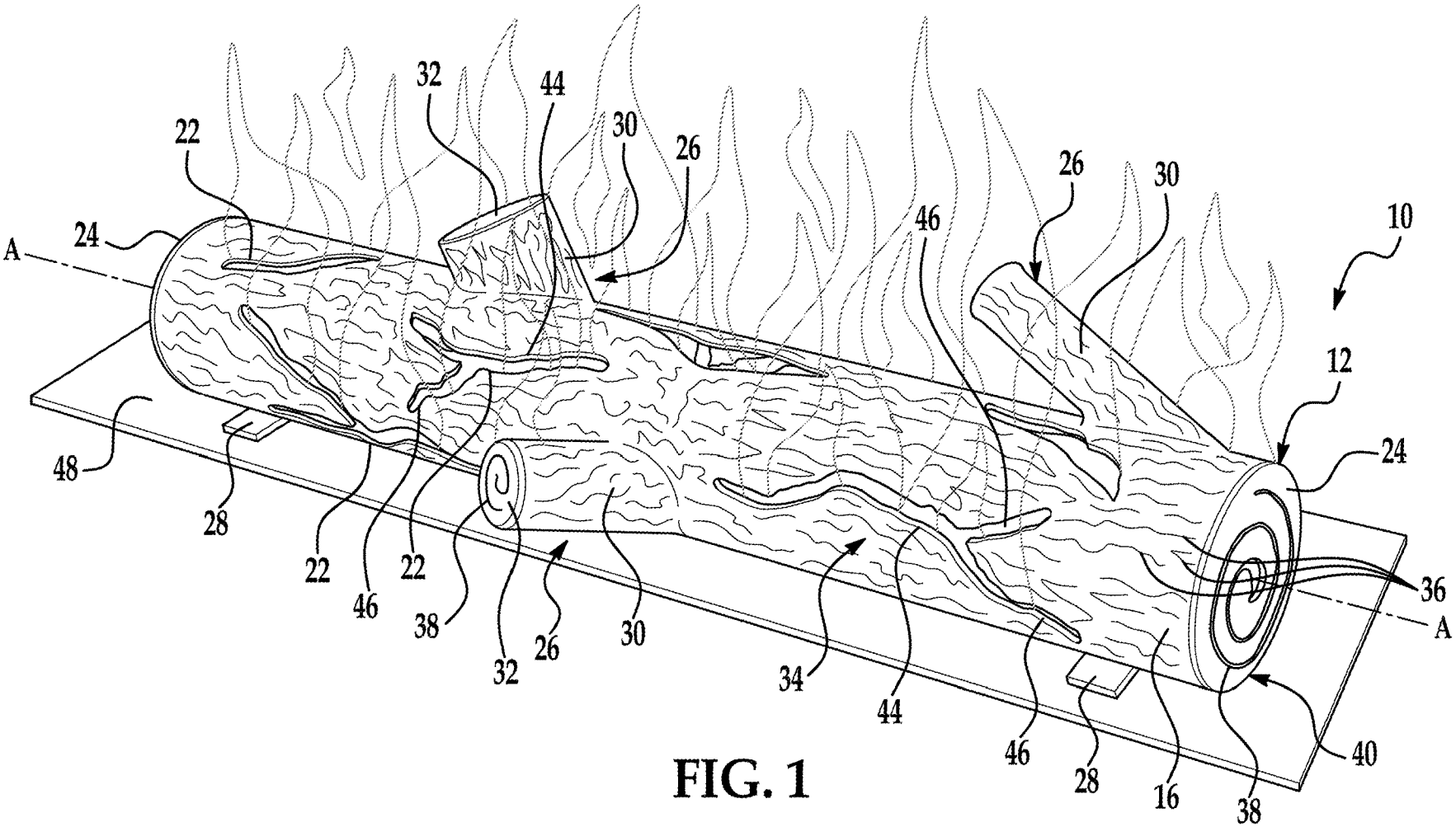
FIG. 1 is a perspective view of an artificial log assembly in use with flames.

With reference to the Figures, wherein like numerals indicate like parts throughout the several views, an assembly 10, i.e., an artificial log burner assembly, is generally shown. The assembly 10 includes an artificial log 12 and a fuel supply 14. The artificial log 12 has an outer wall 16 that is substantially cylindrical. The outer wall 16 is elongated along an axis A. The artificial log 12 has a cavity 18 inside the outer wall 16. The fuel supply 14 is in the cavity 18. The fuel supply 14 has a plurality of fuel outlets 20 closer to the axis A than to the outer wall 16. The fuel outlets 20 are spaced from each other along the axis A. The outer wall 16 includes slits 22 through the outer wall 16 to the cavity 18. At least some of the slits 22 are spaced from each other along the axis A and are spaced from each other circumferentially about the axis A.

The artificial log 12 has the dimensions and appearance of a wood log, i.e., a cut tree trunk or branch, as described further below. Since the fuel supply 14 is in the cavity 18 and the slits 22 extend through the outer wall 16, the flames in the cavity 18 are visible through the slits 22. Specifically, the dancing of the flames in the cavity 18 and shadows in the cavity 18 are visible through the slits 22 because the fuel supply 14 is closer to the axis A than to the outer wall 16. In addition, at least some of the flames may extend from the cavity 18 through the slits 22, i.e., the flames extend externally from the slits 22. In combination, this gives the appearance of a burning log.

Figure 2:
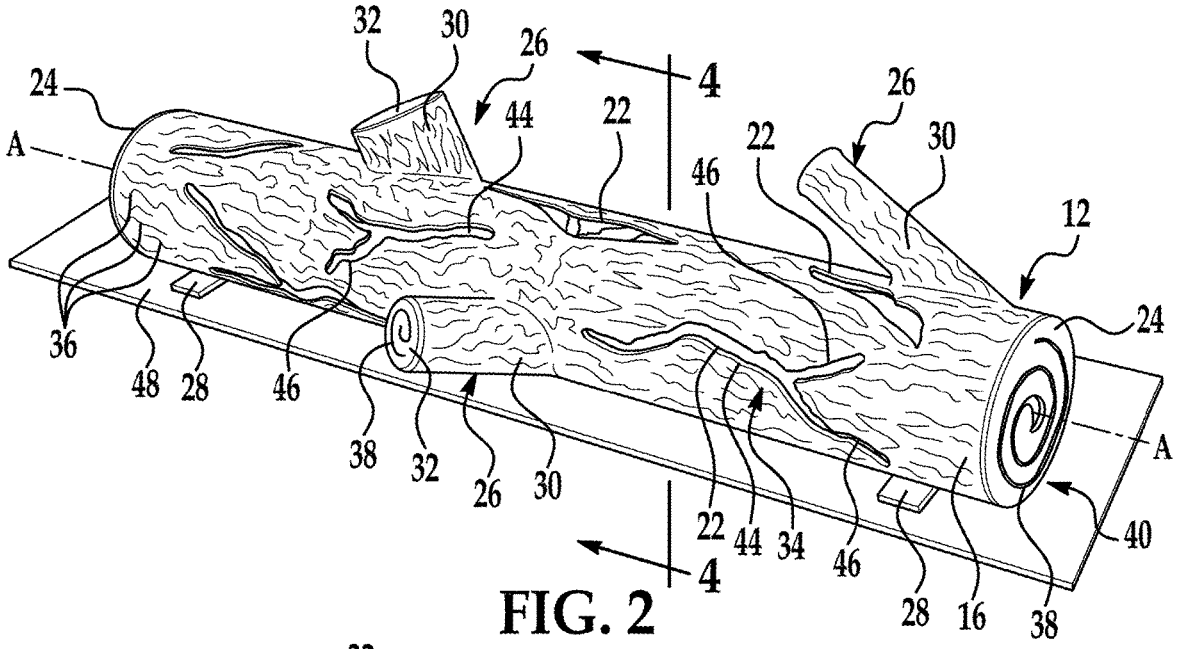
FIG. 2 is a perspective view of the artificial log assembly when not supplied with fuel.
Figure 3:
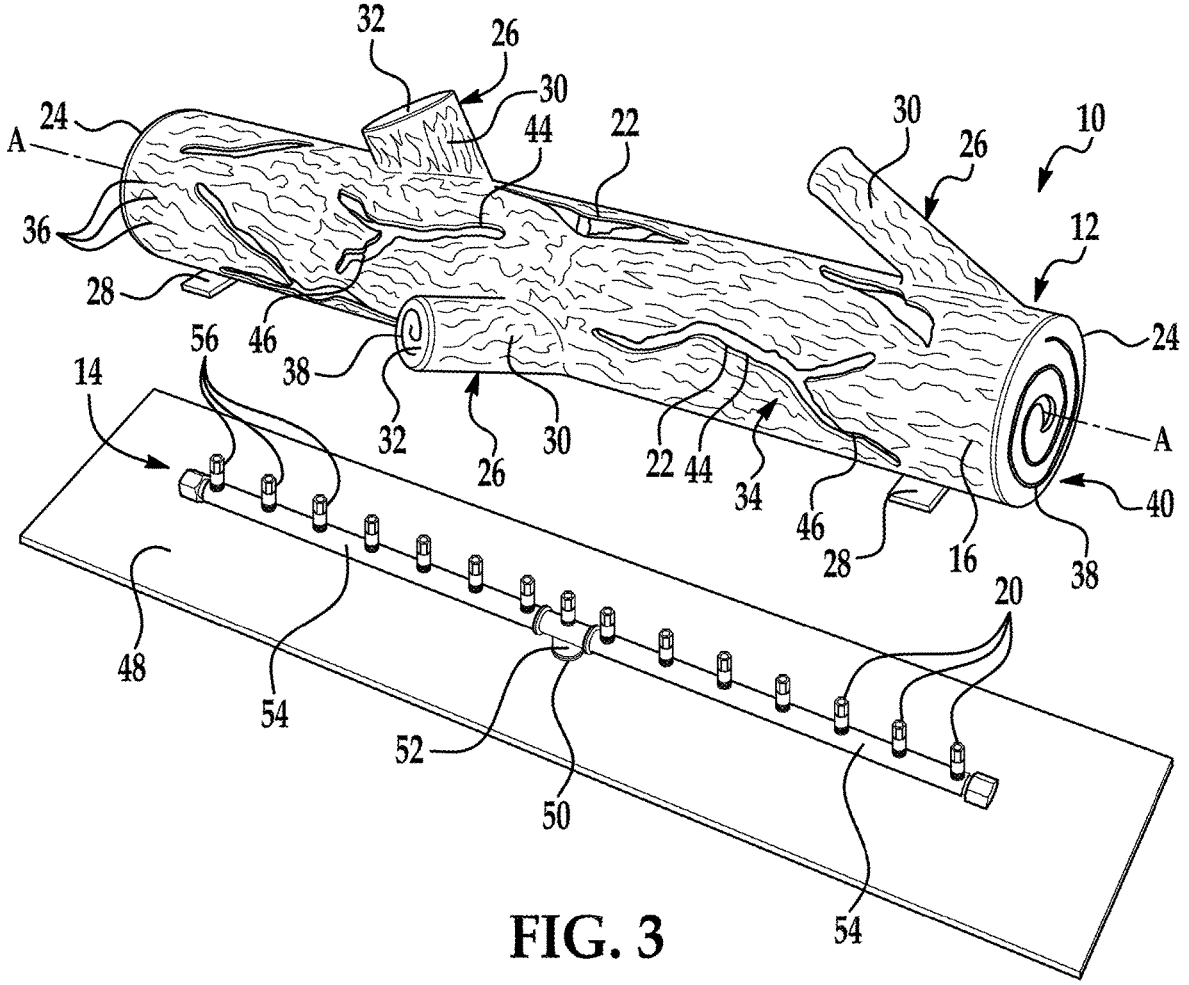
FIG. 3 is a partially exploded view of the log assembly including an artificial log, a fuel supply, and a base.

With reference to FIGS. 1-3, the artificial log 12 includes the outer wall 16 that has the cavity 18 and may include ends 24, limbs 26, and/or feet 28. In the example shown in the Figures, the artificial log 12 includes the ends 24, the limbs 26, and the feet 28. The artificial log 12 may be unitary, i.e., one piece with the components of the artificial log 12 fixed to each other and inseparable without destruction. An example of unitary is welding. For example, some or all of the outer wall 16, the ends 24, the limbs 26, and the feet 28 may be welded together (with "welded" being a structural description, not a description of the process of welding). As another example of unitary, some or all of the components of the outer wall 16, the ends 24, the limbs 26, and the feet 28 may be integrally formed (with "integrally formed" being a structural description, not a description of the process of forming). Examples of being integrally formed includes casting (e.g., die casting, sand casting, pressure casting), machining a blank, additive manufacturing, etc. In examples in which the outer wall 16, the ends 24, and the limbs 26 are unitary, the feet 28 may be unitary (e.g., welded, integrally formed, etc.) to the outer wall 16 or may be fixed to the outer wall 16 in any other suitable manner, e.g., with fasteners. In the examples shown in the Figures, the outer wall 16, the ends 24, the limbs 26, and the feet 28 are unitary. Specifically, the outer wall 16 and bases 30 of the limbs 26 are integrally formed by casting, the end 24 plates and the feet 28 are welded to the outer wall 16, and caps 32 of the limbs 26 are welded to the bases 30, respectively, of the limb 26.

The artificial log 12 may be metal. For example, the artificial log 12 is steel. The outer wall 16, the ends 24, the limbs 26, and the feet 28 may be the same type of material, e.g., steel. In examples in which the artificial log 12 is metal, e.g., steel, the metal is heated by the fuel supply 14 when the fuel supply is lit and the metal radiates heat outwardly.

Figure 4:
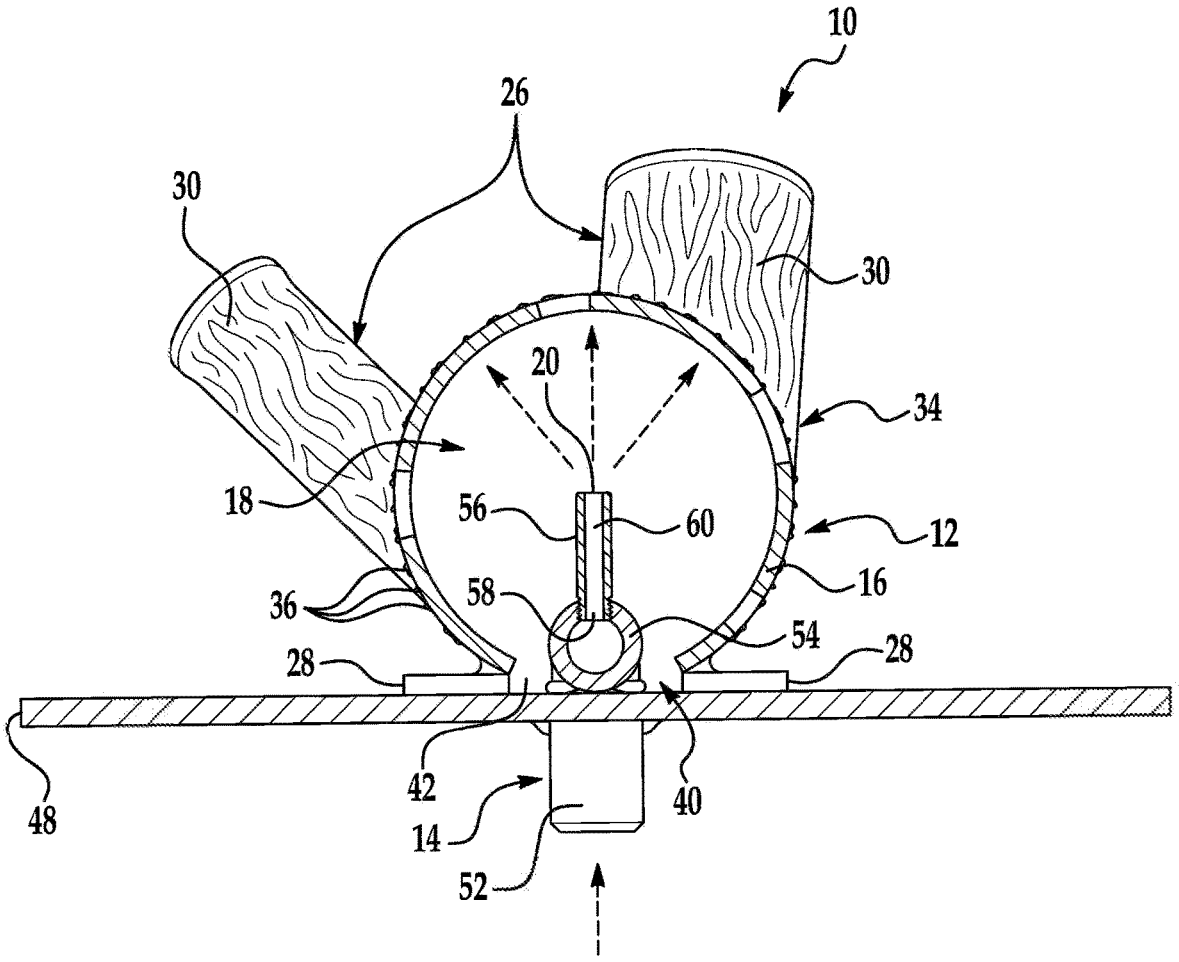
FIG. 4 is a cross-sectional view of the artificial log assembly.

With reference to FIG. 4, the outer wall 16 is substantially cylindrical about the axis A. Specifically, the outer wall 16 is a hollow cylinder, i.e., the artificial log 12 has the cavity 18 inside the outer wall 16. The outer wall 16 (specifically an outer surface 34 and/or an interior surface) may deviate from a perfect hollow, cylindrical shape to provide the appearance of a substantially cylindrical log with some deviation allowed for natural appearance (divots, dips, surface features 36, etc.), manufacturing limitations, manufacturing artifacts (e.g., weld lines, part lines, etc.), etc.

The cavity 18 may be substantially cylindrical. The cavity 18 may extend continuously from one end 24 to the other end 24. The limbs 26 may be hollow, in which case, the cavities of the limbs 26 are open to the cavity 18 of the outer wall 16.

The dimensions of the outer wall 16 provide dancing flames and shadows in the cavity 18 and provide for the visibility of the dancing flames and shadows through the slits 22. The dimensions of the outer wall 16 also provide access for the flames to extend out of the cavity 18 through the slits 22 to the exterior of the artificial log 12.

The outer wall 16 is relatively thin and elongated. Specifically, the outer wall 16 is elongated along the axis A. With continued reference to FIG. 4, the outer wall 16 may have a wall thickness WT less than 1/10 (10%) the outer diameter of the outer wall 16. For example, the outer diameter of the outer wall 16 may be 5 inches (12.7 cm) and the wall thickness WT may be 1/8 inch (0.32 cm). The outer wall 16 may have a substantially uniform wall thickness WT and a substantially uniform outer diameter D. Specifically, the wall thickness WT and outer diameter D may deviate from perfect uniformity to provide the appearance of a substantially cylindrical log with some deviation allowed for natural appearance (divots, dips, surface features 36, etc.), manufacturing limitations, manufacturing artifacts (e.g., weld lines, part lines, etc.), etc.

With reference to FIGS. 1-5, as set forth above, the outer wall 16 is elongated. The outer wall 16 has a length L and the outer diameter D of the outer wall 16 may be less than 1/4 of the length L of the outer wall 16. For example, the outer diameter D of the outer wall 16 may be 5 inches (12.7 cm) and the length L of the outer wall 16 may be 32 inches (81.3 cm).

The ends 24 are fixed to the outer wall 16. For example, as set forth above, the ends 24 may be welded to the outer wall 16. The ends 24 are spaced from each other along the axis A. The ends 24 enclose the cavity 18 therebetween, i.e., the cavity 18 extends 24 from one end 24 to the other end 24 and the ends 24 define the terminal boundaries of the cavity 18. The ends 24 may be identical to each other or different than each other.

The limbs 26 extend transversely from the outer wall 16. The limbs 26 have the appearance of branches extending away from the outer wall 16. The base 30 of the limbs 26 are substantially cylindrical. The bases 30 of the limbs 26 are fixed to the outer wall 16 of the artificial log 12, as described above. As set forth above, the limbs 26 may be hollow, in which case, the cavities of the limbs 26 are open to the cavity 18 of the outer wall 16. Each limb 26 includes an end 24 fixed to the outer wall 16 of the limb 26.

The outer surface 34 of the artificial log 12 may have the appearance of a log, i.e., a cut portion of a tree trunk or branch. For example, the outer surface 34 of the outer wall 16 may have surface features 36 having the appearance of tree bark. In addition, the outer surface of the base 30 of the limbs 26 may have a matching surface feature 36 having the appearance of bark. The surface feature 36 may include, for example, ridges, as shown in the Figures. The ridges extend outwardly from the rest of the outer surface 34. The ridges may be metal, e.g., the same type of metal as the outer wall 16. As another example in addition to or in the alternative to the ridges, the surface feature 36 may include grooves, i.e., the groves extend inward relative to the rest of the outer surface 34. The surface features 36 are elongated, i.e., significantly wider than long. In any event, the majority of the surface features 36, e.g., the ridges or the grooves, are substantially elongated along the axis A. In other words, most of the surface features 36 have a major component of elongation along the axis A to simulate the appearance of bark. Surface features 36 that are substantially elongated along the axis A may have curves, angles, etc., to simulate bark, i.e., the surface features 36 that are substantially elongated along the axis A are not necessarily straight along the axis A from one end to the other end of the surface feature 36. At least some of the surface features 36 are elongated along the axis A and some of the surface features 36 may be elongated transverse to the axis A, and in any event, more of the surface features 36 are elongated along the axis A to simulate bark.

As another example of the appearance of the artificial log 12 as a log, the ends 24 of the artificial log 12 and/or the caps 32 of the limbs 26 may have a smooth outer surface 34, i.e., lacking the surface features 36 on the outer surface 34 of the outer wall 16 and/or on the bases 30 limbs 26, and may have spiral voids 38 in the smooth surfaces. The smooth surfaces simulate cut wood and the spiral voids 38 simulate growth rings of the tree. The spiral voids 38 on the ends 24 of the artificial log 12 and/or the end 24 of the limbs 26 may extend through the end 24 to the cavity 18 such that the cavity 18 is visible through the spiral voids 38. In such an example, the spiral void 38 provides visibility of the dancing flames in the cavity 18.

Figure 5:
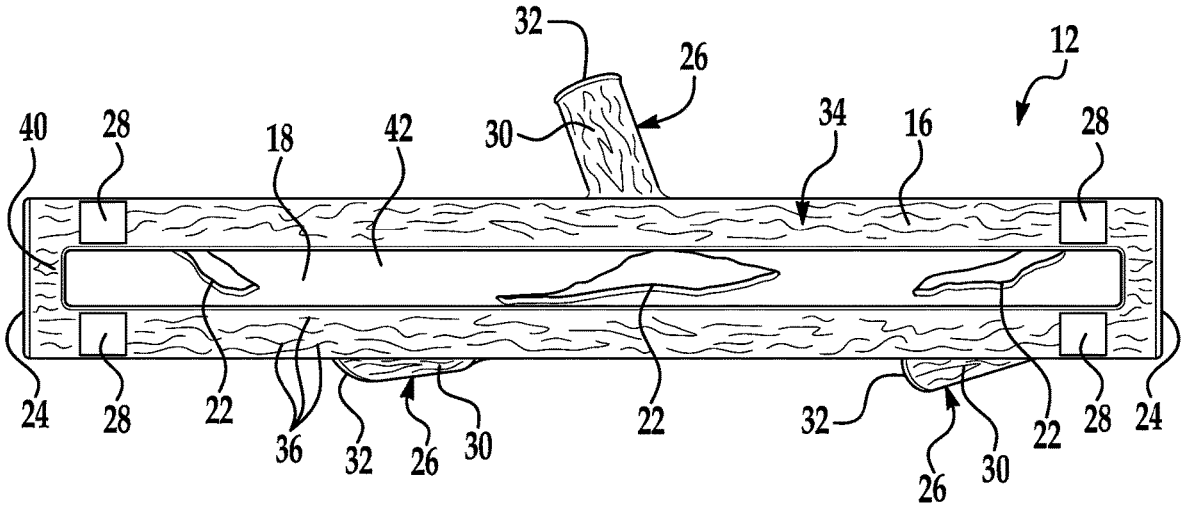
FIG. 5 is a bottom view of the artificial log.
Figure 6:
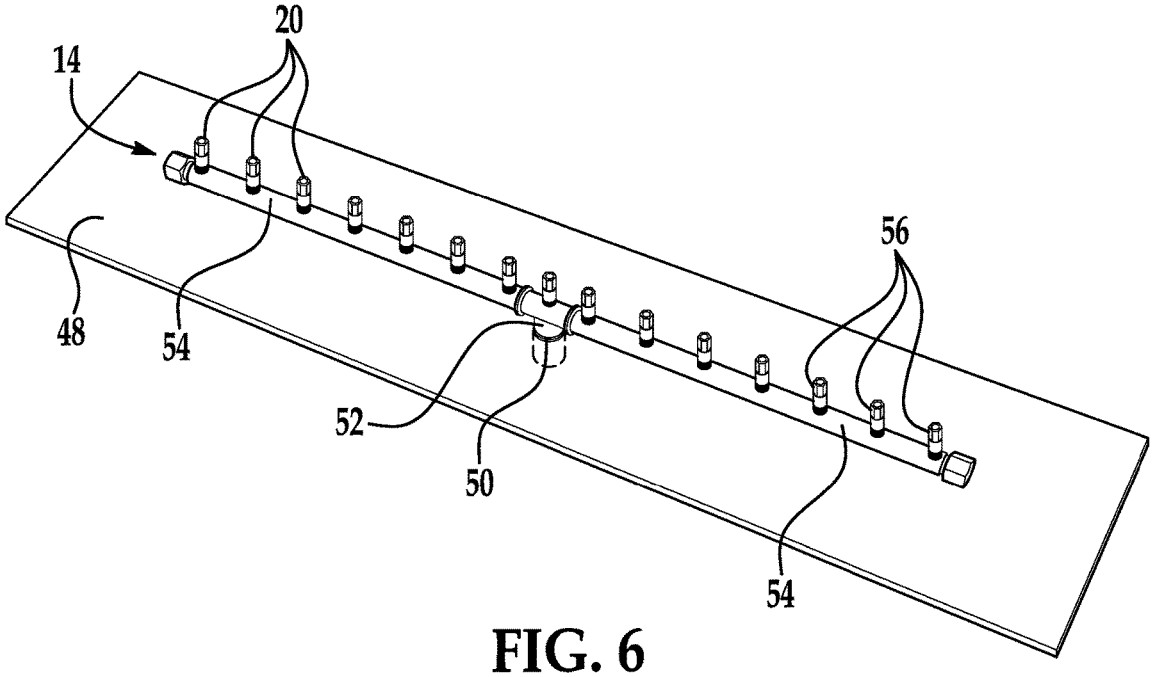
FIG. 6 is a perspective view of the fuel supply and the base.

With reference to FIGS. 4 and 5, the artificial log 12 includes a bottom 40. Specifically, the outer wall 16 has the bottom 40. The bottom 40 may be curved, i.e., following the arc of the rest of the outer wall 16, or may be flat. The bottom 40 has an elongated opening 42 receiving the fuel supply 14.

With reference to FIGS. 1-3, the slits 22 extend through the outer wall 16 to the cavity 18. In other words, the cavity 18 is visible through the slits 22.

The slits 22 are spaced from each other to give an appearance of random arrangement. At least some of the slits 22 are spaced from each other along the axis A and spaced from each other circumferentially about the axis A.

The slits 22 have the appearance of cracks in a log. Each slit 22 may have one or more portions that are elongated along the axis A and/or one or more portions elongated circumferentially about the axis A. For example, one or more of the slits 22 may have an axial portion 44 and a diverging portion 46, as shown in the Figures. The slits 22, e.g., the axial portion 44 and/or the diverging portion 46, are elongated, i.e., are significantly wider than long, as described further below. The axial portion 44 is elongated along the axis A, i.e., a major component of the elongation is along the axis A. The diverging portion 46 extends 24 transversely from the axial portion 44. The diverging portion 46 may be elongated circumferentially about the axis A, i.e., a major component of elongation is circumferential about the axis A. The slits 22, e.g., the axial portion 44 and/or the diverging portion 46 may have curves, angles, etc., to simulate a crack in a log, i.e., the slits 22 are not necessarily straight from one end 24 to the other end 24 of the slit.

As set forth above, the flames in the cavity 18 are visible through the slits 22. As described further below, the dimensions of the slits 22 provide dancing flames and shadows in the cavity 18 and provide for the visibility of the dancing flames and shadows. The dimensions of the slits 22 also provide access for the flames to extend out of the cavity 18 through the slits 22 to the exterior of the artificial log 12. In addition, the dimensions of the slits 22 relative to each other and relative to the dimensions of the outer wall 16 generally conceal the fuel supply 14. Specifically, the dancing flames and shadows in the cavity 18 and the flames extending through the slits 22 are generated, in part, by the dimensions of the slits 22 and the slits 22 generally prevent visibility of the fuel supply 14 through the slits 22.

The slits 22 each have a length LS and a width WS. The length LS is the longest dimension along the outer wall 16 and the width WS is perpendicular to the length LS. The slits 22 may have different lengths and/or different widths. The slits 22 have a thickness measured radially from the axis A, i.e., the thickness is the same as the wall thickness WT of the outer wall 16.

As set forth above, the dimensions of the slits 22 provide visibility of the flames and conceal the fuel supply 14. For example, the greatest width WS of each slit 22 may be less than 1/10 the circumference of the outer wall 16. As an example, the circumference of the outer wall 16 may be 15.75 inches (39.9 cm) and the greatest width WS of the slits 22 may be 0.5-1.0 inches (1.27-2.54 cm). The length LS of each slit 22 may be less than ½ (50%) the length L of the outer wall 16. As an example, the length L of the outer wall 16 may be 32 inches (81.3 cm) and the length LS of each slit 22 may be 5-9 inches (12.7-22.9 cm). As an example, the length LS of each slit 22 along the axis A, i.e., the length LS of the axial portion 44, may be less than ½ (50%) the length of the outer wall 16.

With reference to FIGS. 1-3 and 5-6, the assembly 10 may include a base 48. The base 48 may be metal, e.g., aluminum, stainless steel, etc. The base 48 may include a hole 50. As set forth further below, the fuel supply 14 extends 24 through the hole 50. The base 48 supports the artificial log 12. The bottom 40 and/or feet 28 of the artificial log 12 may rest on the base 48.

As set forth above, the fuel supply 14 is in the cavity 18. The fuel supply 14 may include an inlet 52, at least one pipe 54, and a plurality of jets 56. The inlet 52, the pipe 54, and the jets 56 may be of any suitable material, e.g., brass, black steel, etc. The fuel supply 14 may be designed to supply gaseous fuel, e.g., natural gas, liquid propane, etc. The fuel supply 14 supplies gaseous fuel, which is lit so that the fuel supply 14 fuels flames in the artificial log 12.

The inlet 52 may extend through the base 48. For example, as set forth above, the inlet 52 may extend through the hole 50. Specifically, in such an example, the inlet 52 extends 24 from below the base 48, through the hole 50, to above the base 48. The inlet 52 supplies fuel to the pipe 54. The inlet 52 may be in the cavity 18 when the artificial log 12 is on the base 48. In examples in which the inlet 52 is in the cavity 18, the hole 50 is aligned with the cavity 18 when the artificial log 12 is on the base 48.

At least one pipe 54 extends 24 from the inlet 52 in the cavity 18. Specifically, the pipe 54 may be elongated along the axis A, i.e., parallel with the axis A and on or spaced from the axis A. The pipe 54 may be spaced from the base 48. The pipe 54 delivers fuel from the inlet 52 to the jets 56. The pipe 54 may be connected to the inlet 52 in any suitable fashion, e.g., the inlet 52 may have a female thread and the pipe 54 may have a male thread threadedly engaged with the female thread.

The fuel supply 14 may include more than one pipe 54. In the example shown in the Figures, the fuel supply 14 includes two pipes 54 each extending from the inlet 52. In such an example, as shown in the Figures, the hole and the inlet 52 may be substantially centered on the along the length L of the outer wall 16. The hole, for example, may be centered on the base 48. The pipes 54 may extend in opposite directions along the axis A, i.e., parallel to the axis A and on or spaced from the axis A. In such an example, the inlet 52 may be a T-coupling. The pipes 54 may be of identical length.

The jets 56 extend transversely from the pipe 54. For example, the jets 56 extend upwardly from the pipe 54. The jets 56 may be parallel to each other. The jets 56 are elongated from the pipe 54.

Each jet 56 includes one of the fuel outlets 20, i.e., the fuel outlets 20 are on the jets 56. Each jet 56 includes an inlet end 58, the fuel outlet 20, and a chamber 60 extending from the inlet end 58 to the fuel outlet 20. Fuel is supplied from the pipe 54 into the inlet end 58, and from the inlet end 58 to the fuel outlet 20 through the chamber 60. The jet 56 may include an air orifice between the inlet end 58 and the fuel outlet 20 to intake air to aid in combustion. The jet 56 may be connected to the pipe 54 in any suitable fashion, e.g., the pipe 54 may have a female thread and the jet 56 may have a male thread at the inlet end 58 and threadedly engaged with the female thread.

The jets 56 release fuel for combustion, i.e., the flame is at the jet 56. At least a portion of each jet 56 is in the cavity 18 such that the flame is in the cavity 18. Specifically, the fuel outlets 20 are in the cavity 18. In the example shown in the Figures, the entire jet 56 is in the cavity 18. The fuel outlets 20 are spaced from each other along the axis A. Specifically, the fuel outlets 20 may be spaced from each other in a line along the axis A, i.e., parallel to the axis A and on or spaced from the axis A.

The position of the fuel outlets 20 in the cavity 18 provide dancing flames and shadows in the cavity 18 and provide for the visibility of the dancing flames and shadows through the slits 22. The position of the fuel outlets 20 also provide for the flames to extend out of the cavity 18 through the slits 22 to the exterior of the artificial log 12.

The cavity 18 may be unfilled between the fuel outlets 20 and the outer wall 16. In other words, an air gap is between the fuel outlets 20 and the outer wall 16 and between the fuel outlets 20 and the slits 22.

The fuel outlets 20 may be closer to the axis A than to the outer wall 16. As an example, the fuel outlets 20 may be substantially on the axis A of the outer wall 16. As another example, the fuel outlets 20 may be spaced from the axis A between the axis A and the outer wall 16, e.g., vertically above the axis A. In other words, the outer wall 16 has a height vertically measured from the base 48, and the axis A is at the midpoint of the height. The fuel outlets 20 are between the height and the axis A. Said differently, the fuel outlets 20 are less than halfway from the axis A to the outer wall 16.

The assembly 10 described above has the dimensions and appearance of a wood log, i.e., a cut tree trunk or branch, that is on fire. The dimensions of features of the assembly 10, i.e., components of the artificial log 12 and/or the fuel supply 14, provide dancing of the flames inside the cavity 18 and shadows in the cavity 18. The dimensions also provide for visibility of the dancing flames and shadows in the cavity 18. The dimensions of features of the assembly 10 also provide for the flames to extend from the cavity 18 through the slits 22. Specifically, portions of at least some of the flames are contained by the interior surface of the outer wall 16, causing the flame to dance in the cavity 18 and causing shadows in the cavity 18, and portions of at least some of the flames extend through the slits 22, also leading to the dancing flames and shadows in the cavity 18. The dancing flames and shadows are visible through at least some of the slits 22. The position of the fuel outlets 20 and the spacing of the fuel outlets 20 along the axis A also contribute to the dancing flames and shadows in the cavity 18 as well as the extension of a portion of some of the flames through the cavity 18.

The disclosure has been described in an illustrative manner, and it is to be understood that the terminology which has been used is intended to be in the nature of words of description rather than of limitation. Many modifications and variations of the present disclosure are possible in light of the above teachings, and the disclosure may be practiced otherwise than as specifically described.

What is claimed is:

1. An artificial log assembly comprising:

an artificial log having an outer wall that is substantially cylindrical and elongated along an axis, the artificial log having a cavity inside the outer wall;

a fuel supply in the cavity, the fuel supply having a plurality of fuel outlets closer to the axis than to the outer wall, the fuel outlets being spaced from each other along the axis; and slits through the outer wall to the cavity, at least some of the slits being spaced from each other along the axis and spaced from each other circumferentially about the axis;

the fuel supply includes a pipe elongated along the axis and a plurality of jets extending transversely from the pipe, the jets each having one of the fuel outlets;

the artificial log includes a bottom having an elongated opening receiving the fuel supply;

the artificial log being a non-flammable material.

2. The artificial log assembly of claim 1, wherein the jets are parallel to each other.

3. The artificial log assembly of claim 1, wherein the jets are elongated from the pipe.

4. The artificial log assembly of claim 1, wherein the fuel outlets are spaced from each other in a line along the axis.

5. The artificial log assembly of claim 1, wherein the fuel supply includes an inlet and two pipes, the inlet being substantially centered along a length of the outer wall, the two pipes being of identical length and extending from the inlet in opposite directions along the axis.

6. The artificial log assembly of claim 1, wherein the fuel outlets are substantially on the axis.

7. The artificial log assembly of claim 1, wherein at least some of the slits have at least an axial portion elongated along the axis.

8. The artificial log assembly of claim 7, wherein at least some of the slits have a diverging portion extending transversely from the axial portion.

9. The artificial log assembly of claim 1, wherein the cavity is unfilled between the fuel outlet and the outer wall.

10. The artificial log assembly of claim 1, wherein the outer wall has a substantially uniform wall thickness and a substantially uniform outer diameter, the wall thickness of the outer wall being less than 1/10 the outer diameter of the outer wall.

11. The artificial log assembly of claim 1, wherein the outer wall has a length along the axis and the slits each have a length, the length of each slit being less than ½ the length of the outer wall.

12. The artificial log assembly of claim 1, wherein the outer wall has a length and an outer diameter, the outer diameter of the outer wall being less than ¼ of the length of the outer wall.

13. The artificial log assembly of claim 1, wherein the outer wall has a circumference and the slits each have a length and a width, the greatest width of each slit being less than 1/10 the circumference of the outer wall.

14. The artificial log assembly of claim 13, wherein the outer wall has a length along the axis and the slits each have a length along the axis, the length of each slit being less than ½ the length of the outer wall.

15. The artificial log assembly of claim 1, wherein the outer wall is metal.

16. The artificial log assembly of claim 15, wherein the outer surface includes surface features having the appearance of tree bark.

17. The artificial log assembly of claim 1, wherein the artificial log includes ends fixed to the outer wall and spaced from each other along the axis enclosing the cavity therebetween.

18. An artificial log assembly comprising:

an artificial log having an outer wall that is metal, the outer wall being substantially cylindrical and elongated along an axis, the outer wall having a substantially uniform wall thickness and a substantially uniform outer diameter;

the wall thickness of the outer wall being less than 1/10 the outer diameter of the outer wall;

the outer wall having a length along the axis, the outer diameter of the outer wall being less than ¼ the length of the outer wall;

the artificial log having a cavity inside the outer wall, the cavity being substantially cylindrical, the artificial log including ends fixed to the outer wall and spaced from each other along the axis enclosing the cavity therebetween;

a fuel supply in the cavity, the artificial log including a bottom having an elongated opening receiving the fuel supply;

the fuel supply having a pipe and a plurality of jets spaced from each other along the axis, the jets extending transversely from the pipe parallel to each other, each jet having a fuel outlet that is closer to the axis than to the outer wall; and slits through the outer wall to the cavity, at least some of the slits being spaced from each other along the axis and spaced from each other circumferentially about the axis;

each of the slits having a length, the length of each slit being less than ½ the length of the outer wall.

19. The artificial log assembly as set forth in claim 1, further comprising a base supporting the artificial log above the base, the base having a hole, and the fuel supply extending through the hole from below the base to above the base.

20. The artificial log assembly as set forth in claim 19, wherein:

the pipe is above the base and between the axis and the base; and the jets are above the pipe.

* * * * *